US006766719B2

(12) United States Patent
Van Liempd et al.

(10) Patent No.: US 6,766,719 B2
(45) Date of Patent: Jul. 27, 2004

(54) METHOD AND APPARATUS FOR REMOVING A PLURALITY OF DIE-CUTTED PRODUCTS FROM AN OPERATING AREA OF A DIE-CUTTING APPARATUS HAVING MULTIPLE DIES

(75) Inventors: J. H. Van Liempd, Bavel (NL); L. C. H. Buysen, Heeze (NL); H. K. Nooi, Rosmalen (NL)

(73) Assignee: Van Doorne's Transmissie, B.V., Tilburg (NL)

( * ) Notice: Subject to any disclaimer, the term of this patent is extended or adjusted under 35 U.S.C. 154(b) by 0 days.

(21) Appl. No.: 10/339,952

(22) Filed: Jan. 10, 2003

(65) Prior Publication Data

US 2003/0106403 A1 Jun. 12, 2003

Related U.S. Application Data

(63) Continuation of application No. PCT/NL01/00516, filed on Jul. 6, 2001.

(30) Foreign Application Priority Data

Jul. 14, 2000 (NL) ..... 1015713

(51) Int. Cl.[7] ..... B21D 43/20; B26D 7/32

(52) U.S. Cl. ..... 83/27; 83/153; 83/160; 83/165

(58) Field of Search ..... 83/23, 27, 81, 83/82, 160, 165, 112, 151, 152, 153, 154

(56) References Cited

U.S. PATENT DOCUMENTS

| | | | | | |
|---|---|---|---|---|---|
| 3,546,990 | A | * | 12/1970 | Schneider | 83/27 |
| 3,670,611 | A | * | 6/1972 | Jarman | 83/165 X |
| 3,759,122 | A | * | 9/1973 | Lane et al. | 83/165 X |
| 3,916,741 | A | * | 11/1975 | Comstock et al. | 83/27 |
| 4,833,954 | A | * | 5/1989 | Jenkner | 83/27 |
| 4,836,070 | A | * | 6/1989 | Spano et al. | 83/27 |
| 5,140,839 | A | | 8/1992 | Bruns | |
| 5,347,898 | A | * | 9/1994 | Ito | 83/27 |
| 5,445,053 | A | * | 8/1995 | Kallner | 83/23 |
| 5,993,144 | A | | 11/1999 | Inoue | |
| 2002/0031424 | A1 | * | 3/2002 | Nakajima | 83/152 X |

FOREIGN PATENT DOCUMENTS

| | | |
|---|---|---|
| DE | 44 09 195 A | 9/1994 |
| DE | 200 00 554 U1 | 4/2000 |
| EP | 0 056 143 A | 7/1982 |
| EP | 0 460 623 A | 12/1991 |
| GB | 2 082 094 A | 3/1982 |
| WO | WO 00/30817 | 6/2000 |

* cited by examiner

*Primary Examiner*—Charles Goodman
(74) *Attorney, Agent, or Firm*—Troutman Sanders LLP; Ryan A. Schneider

(57) ABSTRACT

The invention describes a method and an apparatus removing a plurality of die-cut products from an operating area of a die-cutting apparatus having multiple dies. The die-cut products are simultaneously picked up at a pick-up point in the operating area. Then they are simultaneously moved to a delivery point outside the operating area. At the delivery point, the die-cut products are released simultaneously. The operations of picking up moving and releasing are carried out in such a manner that the die-cut products at the delivery point are situated at substantially at the same position with respect to one another as those which they adopt at the pick-up point.

8 Claims, 4 Drawing Sheets

METHOD AND APPARATUS FOR REMOVING A PLURALITY OF DIE-CUTTED PRODUCTS FROM AN OPERATING AREA OF A DIE-CUTTING APPARATUS HAVING MULTIPLE DIES

This is a continuation of Application No. PCT/NL01/00516, filed Jul. 6, 2001.

FIELD OF THE INVENTION

The present invention relates to a method for removing a plurality of die-cut products from an operating area of a die-cutting apparatus having multiple dies.

BACKGROUND OF THE INVENTION

A die-cutting apparatus having multiple dies cuts a plurality of products out of a base material in a single stroke. For this purpose, the base material is positioned between a top table and a bottom table, on which the dies are arranged. During the die-cutting, the bottom table and the top table are pressed against one another and the dies penetrate into the base material. A stroke consists in the bottom table and the top table being moved towards one another, a die-cutting operation and the bottom table and top table being moved away from one another. The operating area of the die-cutting apparatus is formed by the area where the dies are located.

The base material is fed continuously to the die-cutting apparatus and is shaped as a long strip which slides onwards a certain distance after each die-cutting operation. The strip of base material is supported by conveyor rollers.

After each die-cutting operation, the die-cut products have to be removed from the dies. It is known to use a blowing device for this purpose, which blows the die-cut products off the dies, after which they are collected. It is also known to use ejectors which eject the die-cut products from the dies, after which they are likewise collected. The products are generally removed in a direction which is at right angles to the direction in which the strip of base material slides onwards.

When using multiple dies in a die-cutting apparatus, it may be necessary for the die-cut products to be sorted on the basis of origin. In this case, after the die-cutting, die-cut products. originating from a specific die must not be mixed with die-cut products originating from a different die. If the die-cut products are blown off or ejected from the dies, it is not easy to ensure that this is the case. Moreover, methods of this type for removing the die-cut products from the dies have the drawback that it is not altogether certain whether all products will reach a location which is designated for their collection.

SUMMARY OF THE INVENTION

It is an object of the present invention to provide a method for removing a plurality of die-cut products from the operating area of a die-cutting apparatus having multiple dies, in which die-cut products which originate from different dies are not mixed with one another and in which the die-cut products reliably reach the location which is designated for their collection.

This object is achieved by a method which comprises the following steps: substantially simultaneously picking up a plurality of die-cut products at a pick-up point in the operating area; substantially simultaneously moving the die-cut products from the pick-up point to a delivery point outside the operating area; and substantially simultaneously releasing the die-cut products at the delivery point; the die-cut products being fixed with respect to one another at positions which substantially correspond to positions with respect to one another which they adopt at the pick-up point.

The method advantageously comprises the following step: moving the die-cut products from the delivery point to a discharge point located outside the die-cutting apparatus; separate die-cut products being held at different positions.

The method is preferably characterized by moving a transfer member between the pick-up point and the delivery point; bringing the transfer member into an operative state when it is at the pick-up point; and bringing the transfer member into an inoperative state when it is at the delivery point; the transfer member being designed to pick up a plurality of die-cut products at the pick-up point and to release the die-cut products at the delivery point, said transfer member also being designed to fix the die-cut products with respect to one another at positions which substantially correspond to positions with respect to one another which they adopt at the pick-up point.

The die-cut products are always removed from the operating area of the die-cutting apparatus between two die-cutting operations. For this purpose, the transfer member is moved to the pick-up point after each die-cutting operation, the pick-up point being the location where the products are situated after the die-cutting. The transfer member is then activated, so that it is able to pick up the die-cut products. This takes place in such a manner that the die-cut products substantially retain their positions with respect to one another. Then, the transfer member, together with the die-cut products is moved to the delivery point, which is located outside the operating area of the die-cutting apparatus. At the delivery point, the transfer member is deactivated, with the result that the transfer member releases the die-cut products. The positions which the die-cut products adopt with respect to one another at the delivery point substantially correspond to the positions with respect to one another which they adopt at the pick-up point.

The die-cut products are advantageously moved onwards from the delivery point to a discharge point located outside the die-cutting apparatus, where, by way of example, they are collected in receptacles. When the die-cut products are being moved onwards, they are held at different positions, so that products which originate from different dies are not mixed with one another.

If the die-cut products comprise a material which can be attracted by magnetic forces, the transfer member preferably comprises an electrically actuable magnet.

The invention also relates to a die-cutting apparatus having multiple dies and to a removal device for removing a plurality of die-cut products from an operating area of a die-cutting apparatus having multiple dies.

BRIEF DESCRIPTION OF THE DRAWINGS

The method according to the invention and a preferred embodiment of a removal device for use with this method will be explained in more detail in the description which follows with reference to the appended drawing, in which identical reference numerals denote identical or similar components, and in which.

DETAILED DESCRIPTION OF THE PREFERRED EMBODIMENTS

Figure 1:
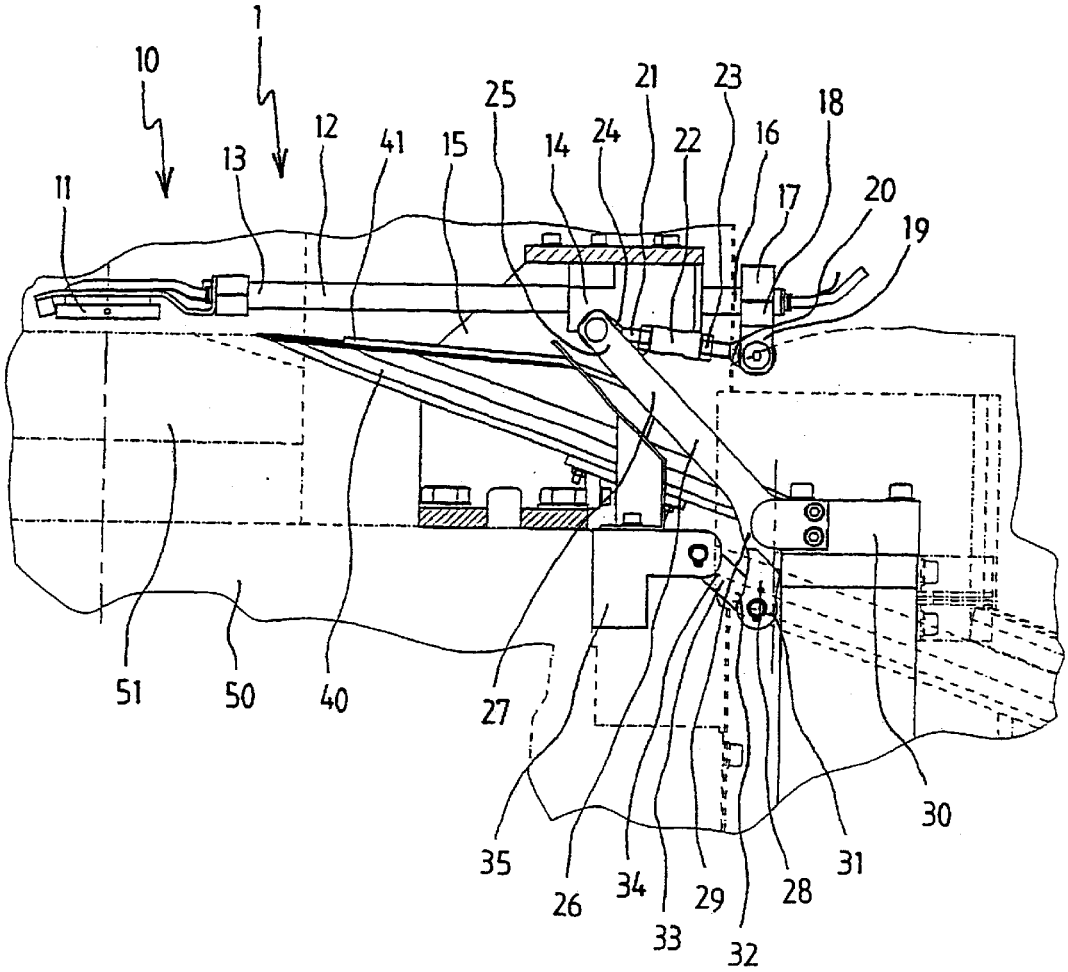
FIG. 1 shows a side view of a removal device according to the invention, in a pick-up position.
Figure 2:
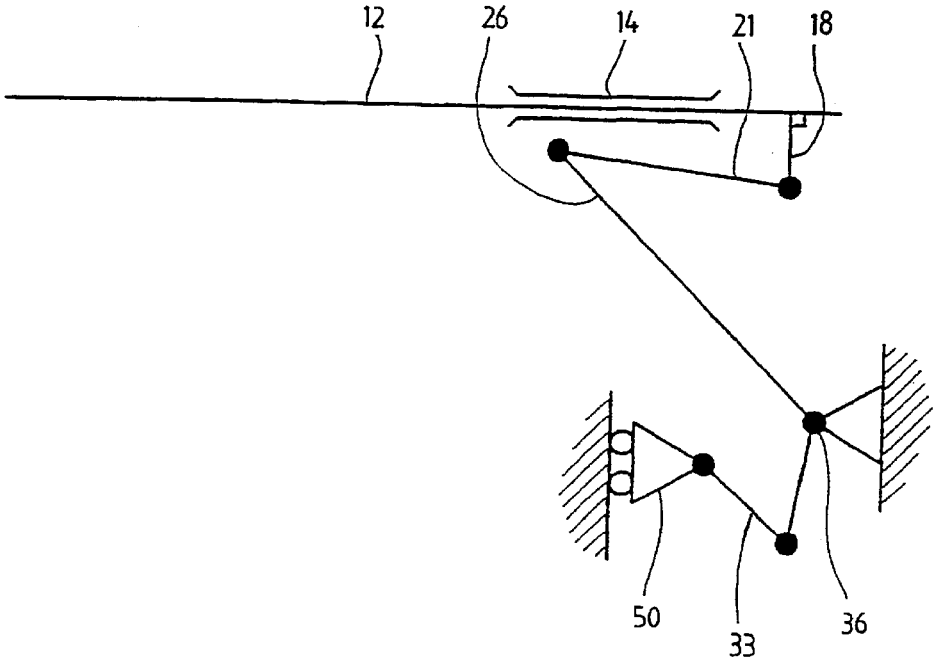
FIG. 2 diagrammatically depicts the removal device shown in FIG. 1.

FIG. 1 shows a removal device for removing a plurality of die-cut products from the operating area of a die-cutting apparatus having multiple dies. The removal device is denoted overall by the reference numeral 1.

The removal device 1 comprises a transfer member which can be moved in linear fashion and is denoted overall by the reference numeral 10. The transfer member 10 comprises an extraction head 11, which in this example is designed as an electrically actuable magnet, and a transfer rod 12, the extraction head 11 being arranged at a first end 13 of the transfer rod 12. Over a section of its length, the transfer rod 12 is surrounded by a guide 14, which is provided, for example, with a ball jacket, by means of which the transfer rod 12 can be supported successfully and can be guided with the minimum possible play. The guide 14 is attached to a holder 15, for example by means of screws, and the holder in turn, in the installed state, is connected to a bottom table, which can be displaced in a vertical direction, of a die-cutting apparatus. In FIG. 1, the bottom table is shown by means of a dashed line, although only in part, and is denoted overall by reference numeral 50. The bottom table 50 bears the dies, which are situated in the area which, in FIG. 1, is denoted by reference numeral 51.

The transfer rod 12 may be designed as a single rod, but with a view to stability is preferably designed as a double rod, in which case the two rods are arranged substantially parallel to one another and-each of the two rods is supported and guided by a ball jacket in the guide 14.

At its second end 16, the transfer rod 12 is connected to a first end 17 of a first connecting rod 18, it being impossible for the transfer rod 12 and the first connecting rod 18 to move with respect to one another. The transfer rod 12 and the first connecting rod 18 could therefore also be designed as a single unit.

At its second end 19, the first connecting rod 18 is pivotably connected to a first rod head 20 of an adjustment rod 21. The adjustment rod 21 is shaped in such a manner that its length can be adjusted as desired. In this example, the adjustment rod 21 comprises a connector 22 which is provided with an internal screw thread, two lock nuts 23, said first rod head 20 and a second rod head 24. Both rod heads 20, 24 are provided with a screw thread, one of the two rod heads 20, 24 and one of the two lock nuts 23 being provided with a left-hand screw thread, and the other of the two rod heads 20, 24 and the other of the two lock nuts being provided with a right-hand screw thread. The connector 22 is provided with both types of screw thread. The length of the adjustment rod 21 can be varied by turning the connector 22. The lock nuts 23 are used to lock the connector 22.

The adjustment rod 21 could also be designed with a fixed length. An adjustable length is advantageous if the removal device 1 is not arranged fixedly at one defined die-cutting apparatus, but rather must be usable for more than one die-cutting apparatus.

The first rod head 20 of the adjustment rod 21 is preferably connected by means of a ball joint to the second end 19 of the first connecting rod 18, since a ball joint is able to absorb forces acting in different directions. Using a ball joint, any lateral movement of the adjustment rod 21 will be transmitted to a lesser extent to the first connecting rod 18 and the transfer rod 12 than when using a different type of joint.

At the second rod head 24, the adjustment rod 21 is pivotably connected to a first end 25 of a rocker rod 26. The rocker rod 26 comprises a first arm 27 and a second arm 28, which are rigidly connected to one another at a fixed angle at a connecting section 29. In this example, the first arm 27 and the second arm 28 are situated in the same plane, and the first arm 27, the second arm 28 and the connecting section 29 are formed as a single unit. The connecting section 29 of the rocker rod 26 is rotatably connected to a fixed column 30, the axis of rotation extending in a direction which is substantially perpendicular to the plane in which the first arm 27 and the second arm 28 are situated, a bearing preferably being used.

The second rod head 24 of the adjustment rod 21 is preferably connected to the first end 25 of the rocker rod 26 by means of a ball joint.

At its second end 31, the rocker rod 26 is pivotably connected to a first end 32 of a second connecting rod 33, which in turn, at its second end 34, is pivotably connected to a support 35 which, in the installed position, is attached to the bottom table 50 of the die-cutting apparatus.

The removal device 1 comprises discharge chutes, which in FIG. 1 are jointly denoted by reference numeral 40. In this example, the discharge chutes 40 are attached to the holder 15. The number of discharge chutes 40 is at least equal to the number of dies used in the die-cutting apparatus, since only products originating from one die may be discharged in any one discharge chute 40. Each discharge chute 40 comprises a collection end 41 for collecting the die-cut products and extends, for example, to as far as a receptacle (not shown) for collecting the die-cut products or a moving belt (not shown), by means of which the die-cut products are moved onwards.

The discharge chutes 40 may be made from steel U-sections, but may also comprise a different material or be of a different form. The shape of the assembly of discharge chutes 40 should be such, that the die-cut products in different discharge chutes 40 cannot be mixed with one another.

The transfer rod 12, the first connecting rod 18, the adjustment rod 21, the rocker rod 26 and the second connecting rod 33 together form a system of rods which is used to enable accurate control of the movement of the extraction head 11 on the basis of the movement of the bottom table 50 of the die-cutting apparatus. The way in which this rod system operates, as well as the way in which the removal device 1 overall operates, will be described below with reference to FIGS. 1–4, FIGS. 2 and 4 only providing a diagrammatic illustration of the pivot points and the rods.

When the die-cutting apparatus is operating, a number of steps are always passed through each stroke. The starting position is defined as the position in which the bottom table 50 is in its lowermost position. From this position, the bottom table 50 is moved upwards, until it meets a top table (not shown), a base material (not shown) being clamped between the top table and a number of dies (not shown) on the bottom table 50. During a die-cutting operation, both tables are together moved a short distance upwards, during which movement the pressure exerted on the base material by the dies is increased, until the dies penetrate into the base material and cut products out of the base material. Then, the bottom table 50 together with the dies is moved back downwards, with the die-cut products remaining on the dies. The base material, which is generally in strip form, is moved onwards a certain distance before the next stroke.

The removal device 1 is used to pick up the die-cut products from the dies. During this operation, it is of essential importance for the movement of the removal device 1 to be adapted to the movement of the tables of the die-cutting apparatus in such a manner that the extraction head 11 cannot become jammed between the top table and the dies on the bottom table 50.

It is also important for the removal device 1 to remove all the die-cut products at each stroke. Therefore, the die-cutting apparatus is generally provided with a security means which signals if a product has remained in place and which is able to stop the movement of the die-cutting apparatus. This security means, which forms part of the die-cutting apparatus, is not shown in the figures.

The movement of the removal device 1 is related to the movement of the bottom table 50. The structure of the system of rods is such that the extraction head 11 moves towards the tables when the bottom table 50 is moving downwards and moves away from the tables when the bottom table 50 is moving upwards. The diagrammatic representation of the removal device 1 in FIGS. 2 and 4 clearly illustrates this relationship between the movements of the removal device 1 and the bottom table 50.

Figure 3:
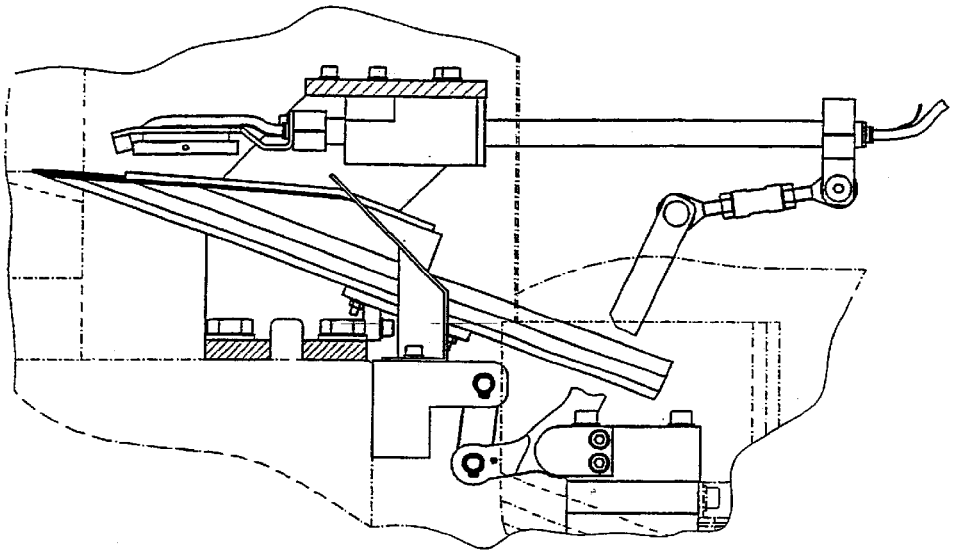
FIG. 3 shows a side view of the removal device according to the invention in a delivery position.
Figure 4:
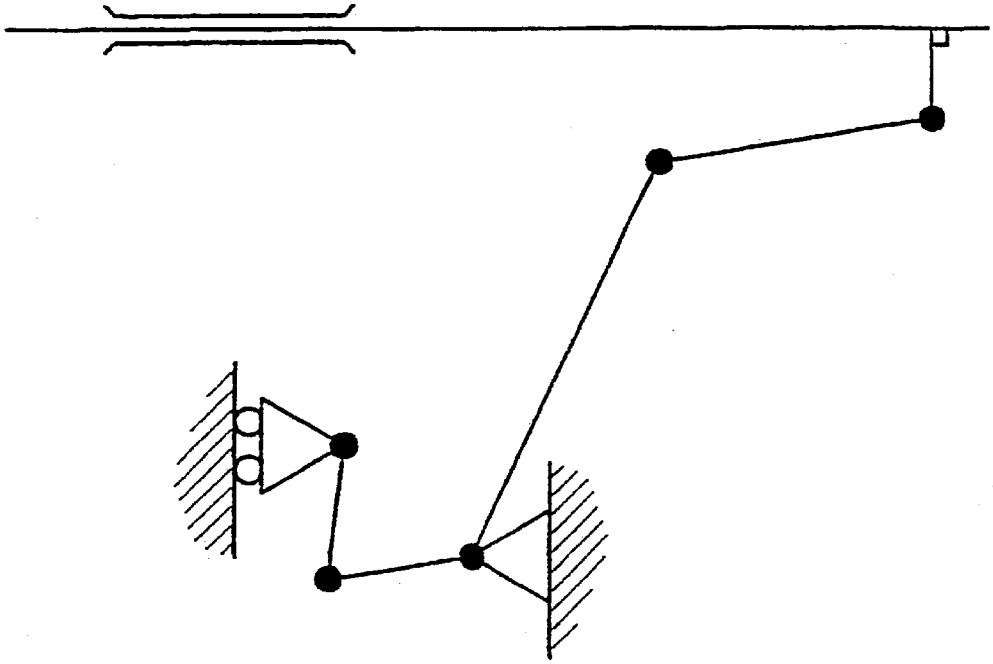
FIG. 4 diagrammatically depicts the removal device shown in FIG. 3.

FIG. 1 shows the removal device 1 in a pick-up position, i.e. the position in which the extraction head 11 is situated above the die-cut products and is picking them up from the dies. The pick-up position is also diagrammatically illustrated in FIG. 2. In the pick-up position, the bottom table 50 is situated in a low position and the distance between the top table and the dies is such that the extraction head 11 can be moved between the top table and the dies. When the bottom table 50 is moved upwards, this movement, via the second connecting rod 33, brings about a rotation of the rocker rod 26 about a rotation point 36. This rotation of the rocker rod 26 and the associated displacement of the first end 25 of the rocker rod 26 results, via the adjustment rod 21 and the first connecting rod 18, in a linear displacement of the transfer rod 12 which is directed away from the tables. When the transfer rod 12 has been moved away from the tables by a distance which is such that the extraction head. 11 is situated above the collection ends 41 of the discharge chutes 40, the removal device 1 is in a release position. The release position is shown in FIGS. 3 and 4.

In this example, the extraction head 11 moves in a direction which is substantially at right angles to the direction in which the dies move. This is advantageous with a view to utilizing the limited free space which is available in the immediate vicinity of a die-cutting apparatus.

In the pick-up position, the extraction head 11 is situated above the die-cut products and is activated in order to pick up the products. In this example, in which the extraction head 11 is an electrically actuable magnet, a magnetic field is generated and, under the influence of the said magnetic field, the products come to bear against the extraction head 11. During the picking-up operation, the die-cut products substantially retain their positions with respect to one another.

During the movement from the pick-up position to the release position, the magnet remains in an operative state. In the release position, the magnet is brought into an inoperative state, so that the die-cut products drop off the magnet. In the release position, the magnet is situated above the collection ends 41 of the discharge chutes 40, so that die-cut products are collected by the said collection ends 41.

The magnet can be actuated by means of activating means which are already being used to activate the die-cutting apparatus. Another possibility is for the magnet to be actuated with the aid of a switch which is arranged in the guide 14 and is actuated by the transfer rod 12.

The discharge chutes 40 can be omitted if the die-cut products, after they have been released by the extraction head 11, can remain at the location where they are collected and do not need to be moved any further.

In this example, the removal device comprises a system of rods which is secured at a fixed rotation point 36 and converts a movement of the dies into a movement of the extraction head 11. As a result, a movement of the extraction head 11 is activated mechanically on the basis of a movement of the dies. The activation could also be produced by electronic means, for example. However, mechanical activation is advantageous since activation of this type is relatively unsusceptible to faults. Moreover, a removal device in which the activation takes place by mechanical means can easily be used for different types of die-cutting apparatus, irrespective of the movement characteristics of the dies.

It will be clear to the person skilled in the art that the scope of the present invention is not limited to the embodiment discussed above, but rather numerous amendments and modifications to this embodiment are possible without departing from the scope of the invention as defined in the appended claims.

For example, the extraction head 11 could be provided with pneumatically actuable suction cups, which are known per se, for picking up the die-cut products and releasing them again, instead of the electrically actuable magnet described above.

Another possibility is for the removal device 1 not to be equipped with a system of rods, but rather with a cam system which provides direct activation of the movement of the extraction head 11 on the basis of the movement of the bottom table 50 of the die-cutting apparatus.

The movement of the extraction head 11 has to be accurately matched to the movement of the tables of a die-cutting apparatus. In the above text, the removal device 1 has been described in connection with a die-cutting apparatus in which the bottom table 50 undergoes most of the displacement and the top table only undergoes a slight displacement during the die-cutting operation, movements of the removal device 1 being related to movements of the bottom table 50. The removal device 1 can also be used for other types of die-cutting apparatus, for example die-cutting apparatus in which the top table undergoes most of the movement. In die-cutting apparatus of this type, the removal device 1 may be installed in such a manner that movements of the removal device 1 are related to movements of the top table.

In the above text, the removal device 1 has been described as mounted on a die-cutting apparatus, but this does not detract from the fact that the removal device 1 in the unmounted state is also covered by the scope of the invention.

What is claimed is:

1. A method for removing a plurality of die-cut products from an operating area of a die-cutting apparatus having multiple dies, comprising the following steps:

substantially simultaneously picking up a plurality of die-cut products at a pick-up point in the operating area;

substantially simultaneously moving the die-cut products from the pick-up point to a delivery point outside the operating area;

substantially simultaneously releasing the die-cut products at the delivery point, the die-cut products being fixed with respect to one another at positions which substantially correspond positions with respect to one another which they adopt at the pick-up point; and moving the die-cut products from the delivery point to a discharge point located outside the die-cutting apparatus, wherein the separate die-cut products are each held at a different position, wherein the separate die-cut products each follow a different discharge trajectory, and wherein, at the discharge point, the die-cut products are sorted on the basis of their origin from a specific die.

2. The method according to claim 1, comprising the further steps of:

moving a transfer member between the pick-up point and the delivery point;

bringing the transfer member into an operative state when it is at the pick-up point; and bringing the transfer member into an inoperative state when it is at the delivery point;

the transfer member being designed to pick up the die-cut products at the pick-up point and to release the die-cut products at the delivery point, the transfer member also being designed to fix the die-cut products with respect to one another at positions which substantially correspond to positions with respect to one another which they adopt at the pick-up point.

3. The method according to claim 2, wherein a movement of the transfer member is actuated on the basis of a movement of the dies of the die-cutting apparatus.

4. A die-cutting apparatus comprising:

multiple dies for simultaneously cutting plurality of products out of a base material;

an operating area where the dies are located;

a transfer member which is movable between at pick-up point in the operating area of the die-cutting apparatus above the die-cut products and a delivery point outside the operating area of the die-cutting apparatus, the transfer member being designed to pick up die-cut products at the pick-up point from the dies, wherein the die-cut products come to bear against the transfer member, and to release the die-cut products at the delivery point, the transfer member also being designed to fix the die-cut products with respect to one another at positions which substantially correspond to the positions with respect to one another which they adopt at the pick-up point; and a discharge member which extends between the delivery point and a discharge point located outside the die-cutting apparatus, the discharge member being designed to hold separate die-cut products at different positions, wherein the discharge member includes separate discharge chutes, the number of discharge chutes at least corresponding to the number of dies.

5. The die-cutting apparatus according to claim 4 further comprising an activating member for activating a movement of the transfer member on the basis of a movement of the dies.

6. The die-cutting apparatus according to claim 5, wherein the activating member comprises a system of rods, the system of rods including a plurality of rods which are pivotably connected to one another, a first rod having a free first end and being pivotably connected, at a second end, to a first end of a second rod, the second rod being pivotably connected, at a second end, to a first end of a third rod, which, at a section of the third rod which is located between its first end and at second end is pivotably connected to a fixed rotation point and which, at the second end of the third rod, is pivotably connected to a first end of a fourth rod, the fourth rod being pivotably connected, at a second end, to a rotation point which is linearly displaceable, and which is connected to the dies.

7. The die-cutting apparatus according to claim 6, wherein the transfer member is connected to the free first end of the first rod of the system of rods, the first rod being enclosed, over a section of its length, by a guide which only allows a linear movement of the first rod.

8. The die-cutting apparatus according to claim 4, wherein the transfer member and the dies are displaceable in directions which are substantially at right angles with respect to each other.

* * * * *